US005845759A

United States Patent [19]

Takada et al.

[11] Patent Number: 5,845,759

[45] Date of Patent: Dec. 8, 1998

[54] CLOTH PIECE TRANSFER APPARATUS WITH SIDE INVERTER

[75] Inventors: Takashi Takada; Toru Yamazaki, both of Osaka, Japan

[73] Assignee: Pegasus Sewing Machine Mfg. Co., Ltd., Osaka, Japan

[21] Appl. No.: 834,126

[22] Filed: Apr. 14, 1997

[30] Foreign Application Priority Data

Apr. 19, 1996 [JP] Japan ..... 8-122664

[51] Int. Cl.[6] ..... B65G 47/24

[52] U.S. Cl. ..... 198/399; 198/395

[58] Field of Search ..... 198/395, 398, 198/399; 271/175, 186

[56] References Cited

U.S. PATENT DOCUMENTS

| | | | |
|---|---|---|---|
| 3,554,354 | 1/1971 | Reid | 198/399 X |
| 4,799,613 | 1/1989 | Adamson | 198/399 X |
| 4,972,935 | 11/1990 | Gross et al. | 198/395 |
| 5,040,778 | 8/1991 | Cole, Jr. | 271/186 X |
| 5,167,406 | 12/1992 | Cole, Jr. | 271/186 X |

*Primary Examiner*—James R. Bidwell
*Attorney, Agent, or Firm*—Jones, Tullar & Cooper, P.C.

[57] ABSTRACT

The cloth piece transfer apparatus with side inverter of the invention is applied to the case of continuous feed of cut cloth pieces into a sewing machine or the like. Pickup 14 pinches holds and lifts the rear portion of the cloth piece N in the process of transfer of the cloth pieces N supplied and supported in horizontal position in uneven sides on a transfer device 4. A rodless cylinder 7 moves the pickup 14 in the transfer direction at a speed faster than the transfer speed of the transfer device 4. The cloth piece N moved by this rodless cylinder 7 is brought into contact with an inverting member 18 disposed beneath the middle position of the moving route of the pickup 14, and the sides of the cloth piece N are inverted. The inverted cloth piece N is dropped and supported on the transfer device 4. It enhances the transfer efficiency and is enable to transfer by inverting the sides without disturbing the interval of the cloth pieces supplied continuously.

3 Claims, 4 Drawing Sheets

FIG. 1(a)
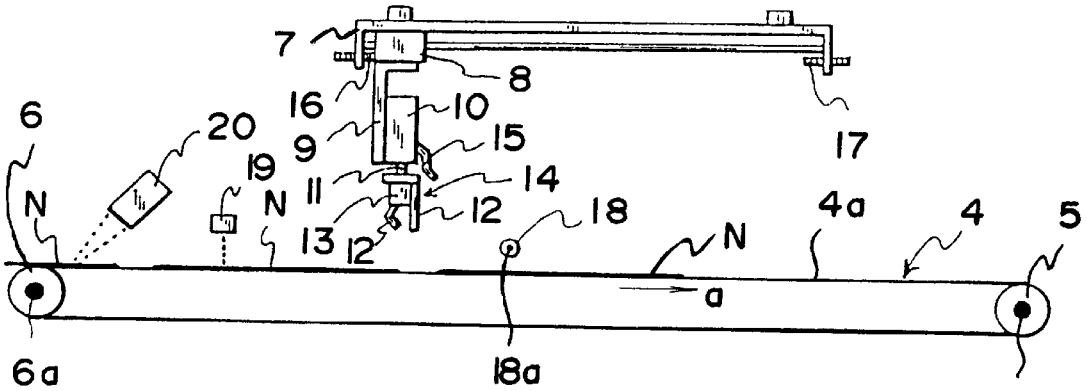
FIG. 1(B)
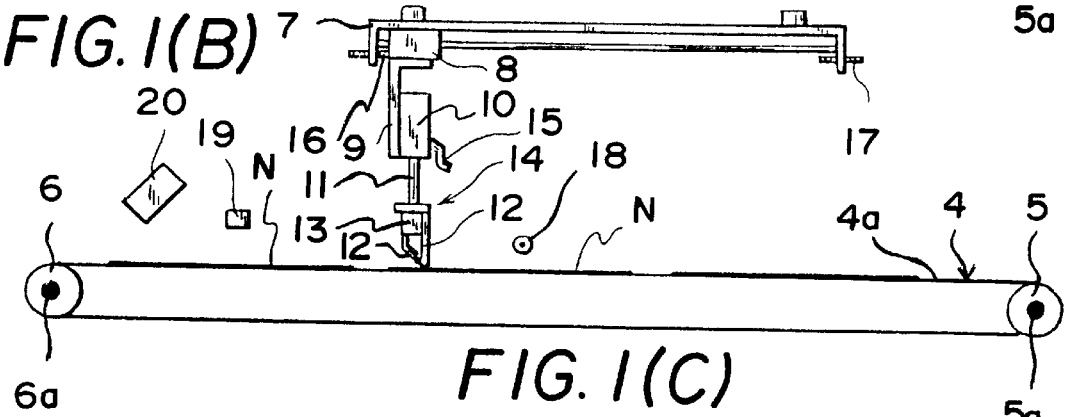
FIG. 1(C)
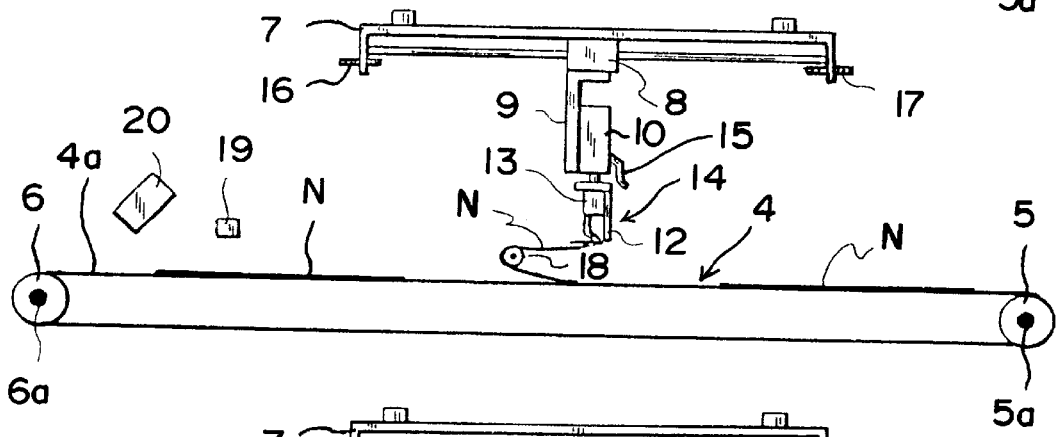
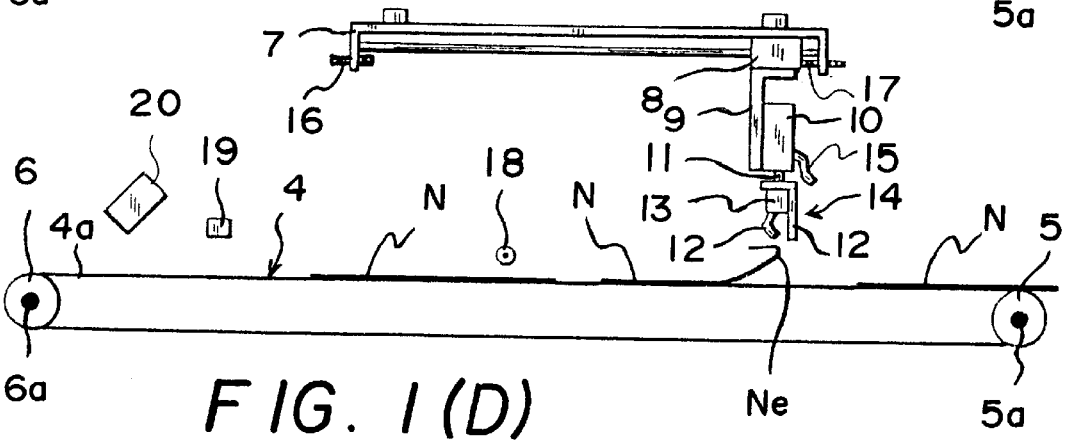
FIG. 1(D)

CLOTH PIECE TRANSFER APPARATUS WITH SIDE INVERTER

BACKGROUND OF THE INVENTION

1. Field of the Invention

The present invention relates to a cloth piece transfer apparatus used in continuous feed of, for example, cut cloth pieces into a sewing machine, and more particularly to a cloth piece transfer apparatus with side inverter constituted so as to invert the sides on the way so that the face and back sides of cloth pieces may be unified in the process of transfer of cloth pieces successively fed irregularly in face and back sides in a specific direction while supporting in horizontal position.

2. Description of the Prior Art

FIG. 4 is to explain the flow of a general sewing process, in which a plurality of cloth pieces cut by a cutting device, not shown, are stacked up on a cloth piece feed source 1. In this cloth piece feed source 1, either cloth pieces individually cut in a specific shape (hereinafter called single cloth pieces) are stacked, or cloth pieces of so-called inner face state, made of a long cloth folded zigzag and cut in specific shape so that the folded inner side comes to the face side (hereinafter called folded cloth pieces) are stacked up. Consequently, the cut cloth pieces stacked up on the cloth piece feed source 1 are placed and supported in horizontal position on a transfer device 2 such as belt conveyor, and are transferred toward a sewing device 3 such as sewing machine, and fed into the sewing device 3. Herein, when handling the former single cloth pieces, by unifying the sides when cutting and stacking up on the cloth piece feed source 1, they can be directly placed and transferred in the stacked state onto the transfer device 2 so that they are fed into the sewing device 3 in unified side state, whereas in the case of handling the latter folded cloth pieces, since the sides to the stacked cloth pieces are inverted by every piece, if they are directly placed on the conveying device 2 and transferred and fed into the sewing device 3, the sides are not uniform, and it causes problems in sewing. Therefore, when handling folded cloth pieces, inverting means for unifying the face and back sides of the cloth pieces is required in the midst of transfer by the conveying device 2.

As the cloth piece transfer apparatus having inverting mechanism meeting such requirement, hitherto, a transfer apparatus as disclosed in Japanese Laid-open Patent 6-178884 has been proposed. The cloth piece transfer apparatus with inverting mechanism as disclosed in the publication comprises a pair of upper and lower transfer rollers consisting of an upper roller driven and rotated in one direction so as to transfer cloth pieces always in one direction, and a lower roller rotating freely, disposed at the inlet of the horizontal transfer route of cloth pieces, a pair of upper and lower transfer rollers consisting of an upper roller driven and rotated in normal and reverse directions, and a lower roller rotating freely, disposed at the outlet of the horizontal transfer route, a pair of upper and lower inverting transfer rollers consisting of an upper inverting roller driven and rotated in normal and reverse direction and a lower rotating roller, of larger diameter than other rollers at intermediate position of the both transfer roller pairs at inlet and outlet, a first transfer route changeover member for changing over and guiding cloth pieces in normal and reverse transfer directions disposed in the cloth piece transfer route of the pair of inverting transfer rollers, and a second transfer route changeover member for changing over and guiding the transferred cloth pieces in ordinary straight transfer route and escape route, disposed at the send-out portion of cloth pieces of the pair of upper and lower transfer rollers at the outlet side.

When a side detector of cloth pieces provided close to the pair of upper and lower transfer rollers at the inlet side detects the back side, the second transfer route changeover member is changed over and operated according to the detection signal, and therefore the cloth piece being transferred by the inlet side and inverting transfer roller pairs is guided to the second transfer route changeover member, and is led into the escape route beneath the outlet side transfer rollers pair. The cloth piece is fed reversely by the outlet side transfer roller pair being driven reversely in this state, while the straight transfer route of the side of the inlet side transfer roller pair is closed, and at the same time inverting transfer roller pair are also driven reversely, and therefore the reversely sent cloth piece is inverted and transferred along the periphery of the upper inverting roller of large diameter. The inverted cloth piece is guided and sent out by the second transfer route changeover member being changed over to the ordinary straight transfer route side.

According to the above conventional cloth piece transfer apparatus with the inverting mechanism, however, the rear end portion of cloth piece is fed reversely by the inverting operation of the inverting transfer roller pair and the outlet side transfer roller pair, and until the rear end portion is sent out from the second transfer route changeover member the next cloth piece is not supplied into the horizontal transfer route. Consequently the cloth piece transfer is inefficient.

When the cloth piece is inverted by the conventional cloth piece transfer apparatus with inverting mechanism being thus constituted, since the cloth piece once sent reversely by the inverting operation of the inverting transfer roller pair and outlet side transfer roller pair is inverted along the periphery of the upper inverting roller of large diameter by the first transfer route changeover member, the time required for the inverted cloth piece until finally sent out is very long as compared with the time required for transferring and sending out along the straight route directly without inverting the cloth piece, and the interval between the cloth piece transferred before and the cloth piece after inversion is widened, and the feed interval of cloth pieces into the sewing machine or the like is largely disturbed.

SUMMARY OF THE INVENTION

It is hence an object to provide a cloth piece transfer apparatus with a side inverter capable of enhancing the transfer efficiency of cloth piece without having to stop feed and transfer of next cloth piece during inversion and transfer of a cloth piece, and transferring by inverting the sides without disturbing the interval of cloth pieces fed continuously.

To achieve the object, the cloth piece transfer apparatus with side inverter of the invention comprises a transfer device for transferring by supporting a cloth piece in horizontal position, a cloth piece side detector for judging face or back side of the cloth piece transferred by the transfer device, and a side inverter for inverting the sides of the cloth piece according to the side judgement by the cloth piece side detector, the side inverter being disposed above the transfer route of the cloth piece transferred by the transfer device, wherein the side inverter comprises pickup means for pinching and holding the rear portion in the transfer direction of the cloth piece transferred by the transfer device, and lifting upward, moving means for moving the pickup means faster than the transfer speed of the transfer device along the transfer direction of the transfer device, an inverting member for inverting the face and back sides of the cloth piece while keeping in contact with the cloth piece transferred as being pinched and held by the pickup means, the inverting member being disposed beneath the moving route intermediate position of the pickup means moved along the transfer direction by the moving means, and control means for controlling pinching, holding and releasing of the cloth piece by the pickup means.

According to the invention having such features, the sides of the cloth pieces are judged by transferring the cloth piece in a specific direction, while placing and supporting in horizontal position on the transfer device in a state not unified in sides. The rear portion in the transfer direction of the cloth piece is pinched, held and lifted up by the pickup means according to the judgement. The cloth piece moved faster than the transfer speed of the transfer device contacts with the inverting member in this state so that the sides of the cloth piece are inverted. The inverted cloth piece is returned onto the transfer device along with pinching, holding and releasing of the pickup means by the control means, and all cloth pieces are sent out as being unified in sides. Thus, only by placing plural cloth pieces successively on the transfer device, the cloth pieces fed in irregular state of sides can be transferred to next process in the state unified in sides. It is not necessary to stop feed and transfer of next cloth piece during inverted transfer, and the transfer efficiency of the cloth piece may be enhanced. Moreover, by moving the cloth piece pinched, held and lifted in the rear portion by the pickup means faster than the transfer speed of the transfer device, the space to the cloth piece transferred next may be held much wider. It can be moved nearly to the rear portion of the cloth piece in the process of transfer as being placed and supported on the transfer device prior to this cloth piece, and therefore the interval of the cloth pieces supplied continuously is not disturbed by inverting. The feed interval of the cloth pieces to the sewing machine can be maintained always at an appropriate interval, so that it is particularly effective in high speed transfer.

Other objects and effects of the invention will be better understood from the following detailed description of the embodiments.

BRIEF DESCRIPTION OF THE DRAWINGS

FIGS. 1 (A) to (D) are schematic side views showing the constitution and operating state of the cloth piece transfer apparatus with side inverter according to the invention.

PREFERRED EMBODIMENT OF THE INVENTION

Figure 2:
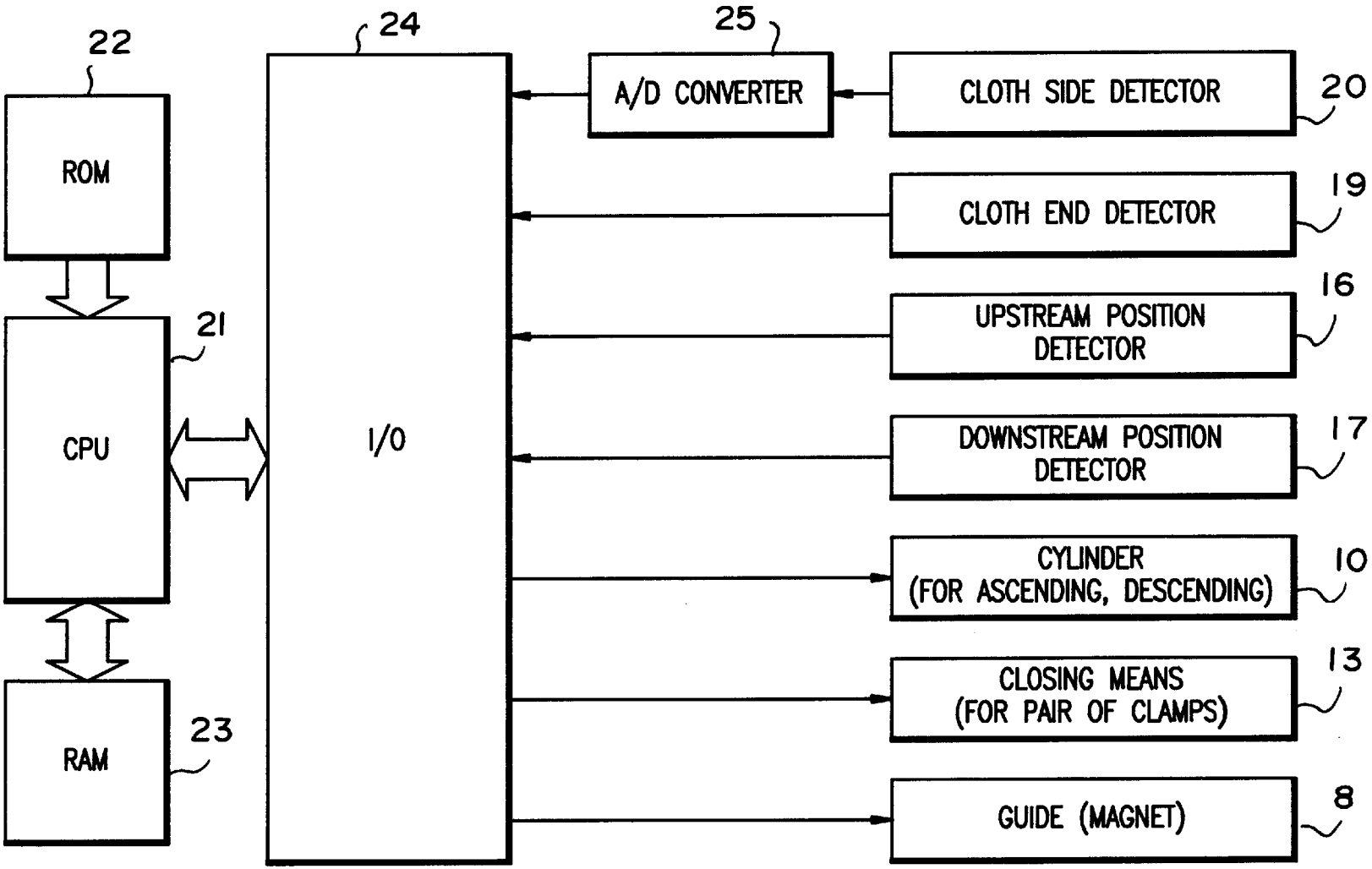
FIG. 2 is a block structural diagram of a control unit in the same apparatus.

Referring now to the drawings, an embodiment of the invention is described in detail below.

FIGS. 1 (A) to (D) are schematic side views showing the constitution and operating state of the cloth piece transfer apparatus with side inverter according to the invention.

In FIG. 1, reference numeral 4 is a transfer device made of an endless belt conveyor, and this transfer device 4 is lying between a driving pulley 5 and a driven pulley 6 rotatably supported about horizontal shafts 5*a*, 6*a* disposed parallel to each other, so that its transfer surface 4*a* may move along the horizontal plane. The driving pulley 5 is driven and rotated by a motor, not shown, controllable in rotating speed, and the driven pulley 6 is free to rotate. It is constituted so that the cloth piece N may be transferred on the transfer plane 4a in the direction of arrow a while placing and supporting in the horizontal position. In this embodiment, an endless belt conveyor is used as the transfer device, but not limited to this, for example, a plurality of rollers may be arranged parallel at proper intervals, and they may be driven and rotated by driving means such as motor.

Above the transfer device 4, pickup moving means composed of a rodless cylinder 7 incorporating a magnet (not shown) moving by feed and discharge of air so as to move reciprocally along the transfer direction of the transfer device 4 is erected horizontally. The reciprocal moving speed of the magnet provided in the rodless cylinder 7 is designed to be freely adjustable by adjusting the feed and discharge rate of the air by a known moving speed adjusting device provided in the rodless cylinder 7 by means of, for example, speed controller (manual).

A bracket 9 is attached to the lower side of a guide 8 moving in response to the magnet in the rodless cylinder 7, and this bracket 9 is furnished with a cylinder 10 incorporating a piston (not shown) expanding and contracting in the vertical direction toward the transfer device 4 by feed and discharge of air. At the lower end of the rod 11 projecting downward from the piston in this cylinder 10, conventional cloth piece pickup means 14 having a pair of clamps 12, 12 and means 13 for opening and closing the pair of clamps 12, 12 are provided. At the downstream side of the transfer direction of the pickup means 14, an air blow device 15 is provided for blowing air toward the cloth piece N and transfer device so that the cloth end Ne may not be curled when the rear portion of the cloth piece N pinched and held by the pickup means 14 is released. Although not shown in this embodiment, it is preferred to dispose a belt support plate at the inside confronting position of the endless belt conveyor portion so that the endless belt conveyor of the transfer device 4 may not be recessed and deformed downward when pinching and holding the rear portion of the cloth piece N as the pair of clamps 12, 12 at the lower end of the pickup means 14 approach the upper surface of the transfer device 4 by the operation of the piston in the cylinder 10.

At the upstream end and downstream end of the rodless cylinder 7 along the transfer direction of the transfer device 4, an upstream position detector 16 and a downstream position detector 17 for detecting the upstream end position and downstream end position of the moving pickup means 14 are provided. Beneath nearly the middle position in the moving route in which the pickup means 14 moves along the rodless cylinder 7, an inverting member 18 composed of a roller supported rotatably about a shaft 18a parallel to the horizontal shafts 5*a*, 6*a* of the driving pulley 5 and driven pulley 6 in the transfer device is disposed. This inverting member 18 is set and provided at an upper position at a proper interval to the transfer plane 4*a* of the transfer device 4 through a height adjusting device not shown. The inverting member 18 is mounted not to contact with the pair of clamps 12, 12 at the lower end of the pickup means 14 when the pickup means 14 moves from the upstream end position to the downstream side of the rodless cylinder 7 by the action of the magnet in the rodless cylinder 7, so as not to disturb the transfer of the cloth piece N supported and transferred in the horizontal position on the transfer device 4. Preferably, as shown in FIG. 1 (C), the pickup means 14 may be set at a height position so that part of the cloth piece N may contact on the transfer device 4 so as not to form wrinkles in the cloth piece N when the cloth piece N transferred by the transfer device 4 is inverted by cooperation of the pickup means 14 and inverting member 18. In the embodiment, as the inverting member 18, a roller supported rotatably about the shaft 18*a* is used, but not limited to this, a bar with a small coefficient of friction on the outer circumference may be also used.

Further, at the upstream side position of the rodless cylinder 7 along the transfer direction of the transfer device 4, a cloth end detector 19 such as photo detector is provided for detecting passing of front end and rear end of the cloth piece N on the transfer device 4. At the upstream side of the cloth end detector 19, a cloth piece side detector 20 for detecting face and back sides of the cloth piece N upper side is provided. This cloth end detector 19 is to sequentially detect the cloth piece N supplied continuously at proper intervals by a cloth piece feeder not shown. The rodless cylinder 7 and pickup means 14 are operated according to the detection signal of the side detector 20. In the embodiment, as the side detector 20, photo detecting means is used, and this detector 20 may be also disposed in the cloth piece feeder in the preceding process not shown, as well as in the upper part of the transfer device 4. Moreover, in the embodiment, in order that the cloth piece side detector 20 may not operate all the time, the cloth end detector 19 is disposed at the downstream side of the transfer direction of the cloth piece side detector 20, but the longitudinal configuration of the two detectors 19, 20 in the transfer direction may be reversed.

FIG. 2 is a block diagram of a control unit in the cloth piece transfer apparatus with side inverter shown in the embodiment. The diagram shows a CPU 21, a ROM 22 for storing basic operation program of the rodless cylinder 7 and pickup means 14, a RAM 23 for storing data for changing the timing of each action corresponding to the size of the cloth piece N supplied from the cloth piece feeder, an I/O 24, an A/D converter 25 for converting the analog signal of detection result of the cloth piece side detector 20 into a digital signal.

Figure 3:
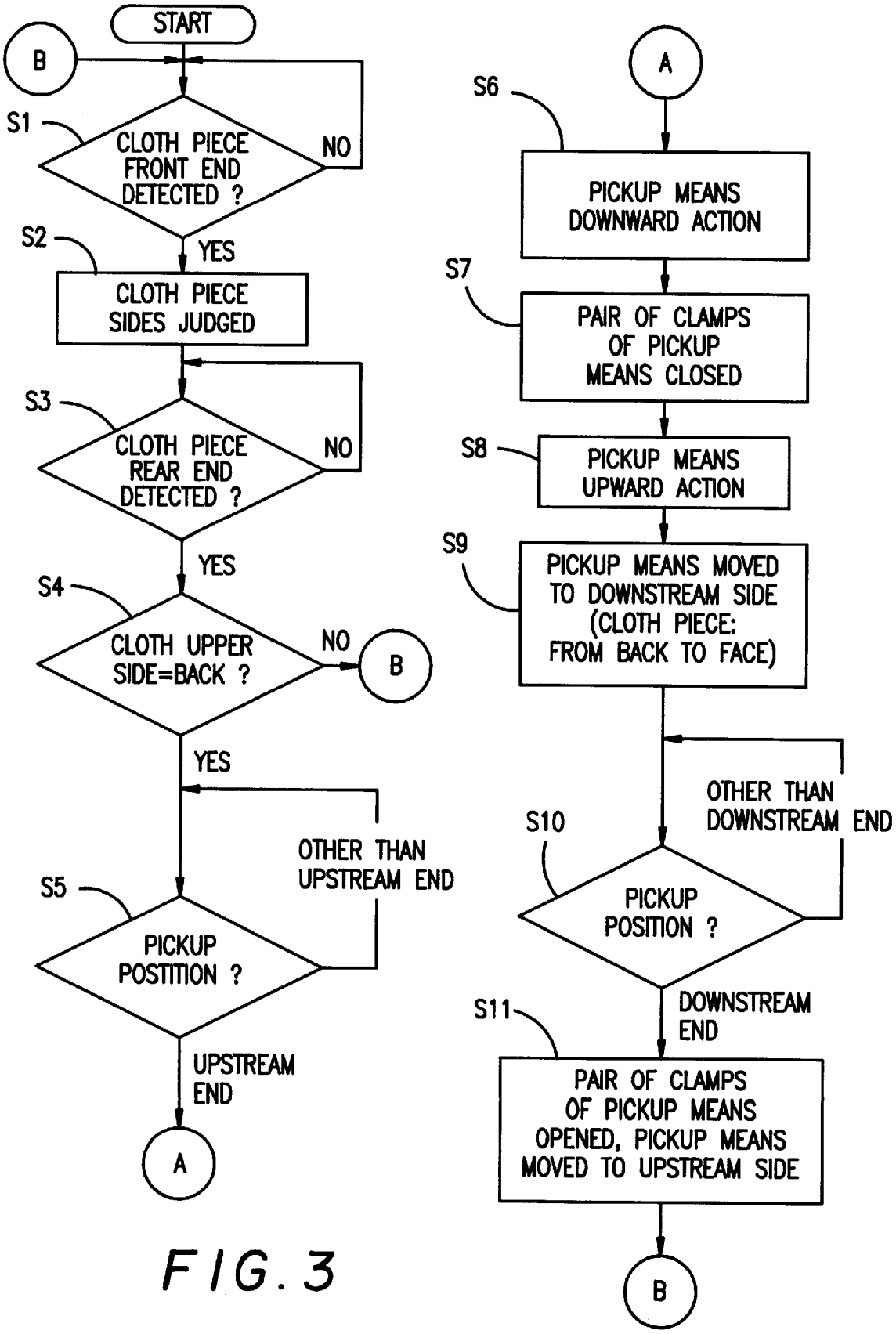
FIG. 3 is a flowchart for explaining the operation of the same apparatus.
Figure 4:
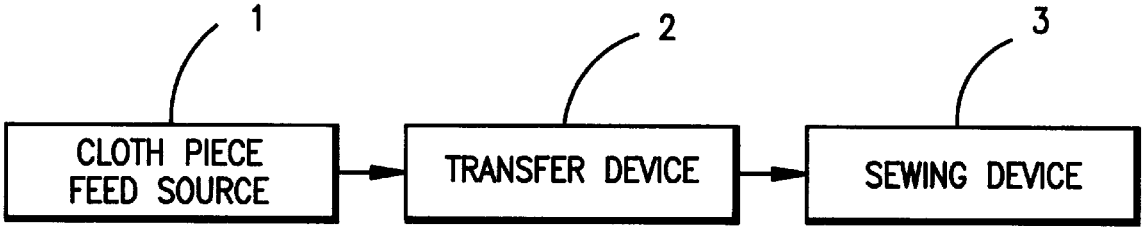
FIG. 4 PRIOR ART
FIG. 4 is a schematic diagram for explaining the flow of general sewing process.

Next is described the operation of inverting and transferring the cloth pieces N uniformly on the same side, while feeding cloth pieces continuously by using the cloth piece transfer apparatus with side inverter of the above constitution, by referring to FIG. 1 and FIG. 3.

First, by the cloth piece feeder not shown, when the cloth piece N is placed and supported on the transfer device 4 in horizontal position, the front end portion of this cloth piece N in the transfer direction is sequentially detected by the cloth end detector 19 (step S1), and the cloth piece side detector 20 is actuated according to the detection action by this cloth end detector 19, and the upper side of the transferred cloth piece N is judged (step S2). Consequently, the rear end portion in transfer direction of the cloth piece N transferred by the transfer device 4 is detected by the cloth end detector 19 (step S3), and it is confirmed if the result of judgement at step S2 was back or not (step S4). At this step S4, when the upper side of the cloth piece N is judged to be face, the process returns to step S1. If the cloth piece N is judged to be back, it is detected by the upstream position detector 16 whether the present position of the pickup means 14 is at the upstream side end in the transfer direction of the rodless cylinder 7 or not (step S5), and it starts counting the number of times of set timing for extending and operating the rod 11 of the cylinder 10 having the pickup means 14 at the lower end downward in the vertical direction.

Then, at step 55, when the pickup means 14 is at the upstream end position of the rodless cylinder 7, and the count reaches the number of times of set timing, the rod 11 of the cylinder 10 is extended and operated downward in the vertical direction (step S6). As shown in FIG. 1 (B), the pair of clamps 12, 12 of the pickup means 14 are closed by the means 13, and the rear portion in the transfer direction of the cloth piece N is pinched and held by the pair of clamps 12, 12 (step S7). In succession, the rod 11 of the cylinder 10 retracts upward in the vertical direction, and the rear portion of the cloth piece N is lifted (step S8).

Consequently, the magnet incorporated in the rodless cylinder 7 is actuated, and the pickup means 14 is moved horizontally faster than the transfer speed of the transfer device 4 toward the downstream side along the transfer direction of the transfer device 4 (step S9). The downstream position detector 17 disposed at the downstream side of the rodless cylinder 7 detects the arrival of the pickup means 14 at the downstream end (step S10). As a result, as shown in FIG. 1 (C), during horizontal move of the pickup means 14, the upper surface of the cloth piece N contacts with the inverting member 18, and the sides of the cloth piece N are inverted on the boundary of the contacting portion. At this time, the rear portion of the cloth piece N to be inverted is moved nearly to the rear end of the cloth piece N one step before (already inverted and transferred) transferred nearly to the downstream end of the transfer device 4, so that the interval may be narrowed.

At step S10, when the downstream position detector 17 detects the arrival of the pickup means 14, the pair of clamps 12, 12 of the pickup means 14 are released by the means 13, and pinching hold of the cloth piece N is released, and the cloth piece N is dropped onto the transfer plane 4*a* of the transfer device 4, and by the operation of the magnet incorporated in the rodless cylinder 7, the pickup means 14 is reset and moved toward the upstream side in the transfer direction of the transfer device 4 (step S11), to be ready for transfer of next cloth piece N. Besides, in order that the end portion Ne side of the cloth piece N may not be curled on the transfer device 4 when releasing the pair of clamps 12, 12 of the pickup means 14, when the pickup means 14 is reset and moved to the transfer direction upstream side, air is blown to the cloth piece N from the air blow device 15, thereby preventing the end portion Ne of the cloth piece N from being curled.

The operation explained herein is the inverting operation of one cloth piece N, but the process from step S1 to step S4 in the flowchart is done sequentially on the continuously supplied cloth pieces N, and when the process at step S11 in the flowchart is over, the operation for next cloth piece N may be advanced up to step S5 of the flowchart.

The entire disclosure of Japanese Patent Application No. 8-122664 filed on Apr. 19, 1996, including the specification, claims, drawings, and summary is incorporated herein by reference to its entirety.

What is claimed is:

1. A cloth piece transfer apparatus with side inverter comprising:

a transfer device for transferring by supporting a cloth piece in horizontal position, a cloth piece side detector for judging face or back side of the cloth piece transferred by the transfer device, and a side inverter for inverting the sides of the cloth piece according to the side judgement by the cloth piece side detector, the side inverter being disposed above the transfer route of the cloth piece transferred by the transfer device, wherein the side inverter comprises:

pickup means for pinching and holding the rear portion in the transfer direction of the cloth piece transferred by the transfer device, and lifting upward, moving means for moving the pickup means faster than the transfer speed of the transfer device along the transfer direction of the transfer device, an inverting member for inverting the face and back sides of the cloth piece while keeping in contact with the cloth piece transferred as being pinched and held by the pickup means, the inverting member being disposed beneath the moving route intermediate position of the pickup means moved along the transfer direction by the moving means, and control means for controlling pinching, holding and releasing of the cloth piece by the pickup means.

2. A cloth piece transfer apparatus with side inverter of claim 1, wherein the moving means is provided with an air blow device for blowing air to the cloth piece released of gripping and holding by the pickup means.

3. A cloth piece transfer apparatus with side inverter of claim 1, further comprising a cloth end detector for detecting passing of front and rear ends in transfer direction of the cloth piece transferred by the transfer device, wherein the cloth piece side detector is designed to detect and operate according to the detection signal by this cloth end detector.

* * * * *